US005556097A

United States Patent [19]

Endo et al.

[11] Patent Number: 5,556,097

[45] Date of Patent: Sep. 17, 1996

[54] HOLLOW CLUB HEAD WITH WELDED HOSEL

[75] Inventors: Eimatsu Endo; Kenji Kobayashi, both of Tsubame, Japan

[73] Assignee: Kabushiki Kaisha Endo Seisakusho, Japan

[21] Appl. No.: 359,418

[22] Filed: Dec. 20, 1994

Related U.S. Application Data

[62] Division of Ser. No. 245,874, May 19, 1994, abandoned.

[30] Foreign Application Priority Data

| | | | |
|---|---|---|---|
| May 31, 1993 | [JP] | Japan | 5-129620 |
| May 19, 1993 | [JP] | Japan | 5-117328 |
| Dec. 28, 1993 | [JP] | Japan | 5-334330 |
| Feb. 18, 1994 | [JP] | Japan | 6-21399 |
| Feb. 22, 1994 | [JP] | Japan | 6-24319 |
| Feb. 28, 1994 | [JP] | Japan | 6-30240 |
| Mar. 7, 1994 | [JP] | Japan | 6-35844 |
| Apr. 5, 1994 | [JP] | Japan | 6-67365 |
| Apr. 6, 1994 | [JP] | Japan | 6-68786 |

[51] Int. Cl.[6] ..... A63B 53/04

[52] U.S. Cl. ..... 473/309; 473/345

[58] Field of Search ..... 273/77 R, 167 H, 273/167 K, 80.2, 80.3, 80.4, 80.5, 80.6, 80.8

[56] References Cited

U.S. PATENT DOCUMENTS

| | | | |
|---|---|---|---|
| 1,553,867 | 9/1925 | Maas | 273/80.3 |
| 3,810,621 | 5/1974 | Mills | 273/174 |
| 4,417,731 | 11/1983 | Yamada | 273/167 H |
| 5,232,224 | 8/1993 | Zeider | 273/80.2 |
| 5,346,217 | 9/1994 | Tsuchiya et al. | 273/172 |

*Primary Examiner*—Vincent Millin
*Assistant Examiner*—William M. Pierce
*Attorney, Agent, or Firm*—Quarles & Brady

[57] ABSTRACT

A golf club head having a metallic and hollow head body, of which the volume is capable of being enlarged without decreasing the connection strength of a shaft. A hosel is formed thicker at its lower end than at its upper end, while a lower end of a shaft is provided evenly relative to a lower end of the hosel, or otherwise, protrudes slightly downward relative to the same. Thus, a length of the shaft can be saved without decreasing the connection strength of the same to the head body. In another embodiment of the invention, a collar is preformed at an intermediate portion of the hosel, thereby improving the connection strength of the hosel and shaft to the head body, and at the same time, metallic cladding will be unnecessary in manufacturing a golf club head, thereby improving its productivity.

5 Claims, 9 Drawing Sheets

HOLLOW CLUB HEAD WITH WELDED HOSEL

CROSS REFERENCE TO RELATED APPLICATIONS

This application is a divisional application of U.S. patent application Ser. No. 245,874 filed on May 19, 1994, now abandoned.

BACKGROUND OF THE INVENTION

1. Field of the Invention

The present invention relates to so-called metal wood, especially to a hosel for connecting a shaft thereto.

2. Description of Prior Art

In recent years, for improvement of a sense of stability in hitting balls, a golf club head with a larger volume has been desired. According to prior art, however, as a distal end of a shaft penetrating through a hosel is connected to a sole, a length of a shaft within a head body is elongated, thereby increasing an entire weight of a golf club head, resulting in decreasing a volume of a head body which must be manufactured within a regular value of an entire weight. To eliminate such problem, for example, Japanese Utility Model Publication No. 63-17491 discloses a hosel formed by folding metallic crust and a shaft to be inserted thereinto which is positioned at a distance off above a sole. However, such prior art has a problem that a connection strength of a shaft to a head body is comparatively weak or low.

Further, there is also proposed another prior art for improvement of a connection strength of a shaft, which is explained with reference to FIGS. 9 to 11, wherein a reference numeral 31 is a metallic and hollow golf club head consisting of a main body member 32, a face member 33, an upper crust member 34 and a hosel member 35. These members 32 to 35 are made of titanium alloy respectively, being welded to one another. The main body member 32 forms a sole 36, a heel 37, toe 38 and a back 39 of a golf club head 31, constructing a container-shaped head body 31*a* together with the face member 33. The upper crust member 34 is tabular and secured onto the head body 31*a*, covering the same. The upper crust member 34 has a cut-out portion 40 at its heel 37 side. The hosel member 35 is formed cylindrical, while a flange 41 formed at a distal end thereof is welded to a sole 36 at its heel 37 side. An intermediate portion of the hosel member 35 is welded to the ends of the upper crust member 34, the face member 33 and the main body member 32 respectively.

In welding the above members, a cladding 42 is formed by certain filler material so that an upper surface of the upper crust member 34, an outer side-peripheral surface of the face member 33 and the main body member 32 and an upper peripheral surface of the hosel member 35 can form gently-curved continuous surface. Thereafter, to the hosel member 35 is connected a shaft 43.

However, according to the prior art, as an intermediate part of the cylindrical hosel member 35 is allowed to pass through the cut-out portion 40 of the upper crust member 34 in order to be welded to the upper crust member 34, the face member 33 and the main body member 32 respectively, the connection strength of the hosel member 35 to these members 32 to 34 has been comparatively low. Further, to improve the connection strength and finish its appearance, it would be necessary to form the cladding 42 for forming the gently-curved continuous surface extending from the upper surface of the upper crust member 34 up to the upper portion of the outer peripheral surface of the hosel member 35, thus necessitating much cladding in welding. Consequently, such prior art has further resulted in low productivity.

SUMMARY OF THE INVENTION

To eliminate the above-mentioned problems, it is, therefore, an object of the present invention to provide a golf club head of which the shaft is connected to the head body in a more secure manner without decreasing a volume of the head body.

It is another object of the present invention to provide a golf club head of which the hosel is more securely connected to the head body.

It is further an object of the present invention to provide a golf club head having an excellent productivity in manufacturing the same.

According to a major feature of the present invention, a golf club head having a metallic and hollow head body and a hosel member connected to its heel side for securely inserting a shaft thereto, which is characterized in that: the hosel member is formed thicker at its lower end for joining an upper side of the head body thereto than at its upper end and; a lower end of the shaft is provided evenly relative to the lower end of the hosel member, or otherwise, protrudes slightly downward relative to the same.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
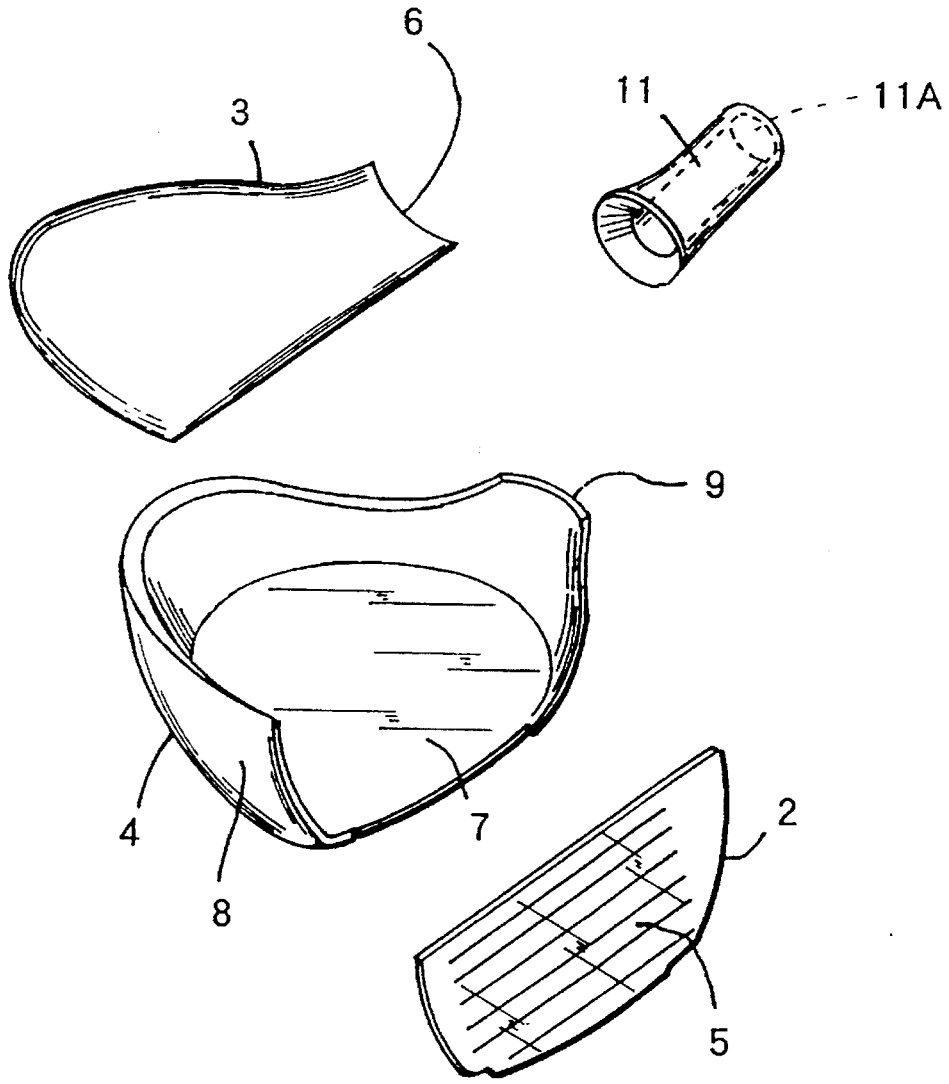
FIG. 1 is an exploded perspective view showing a first embodiment of the invention.
Figure 2:
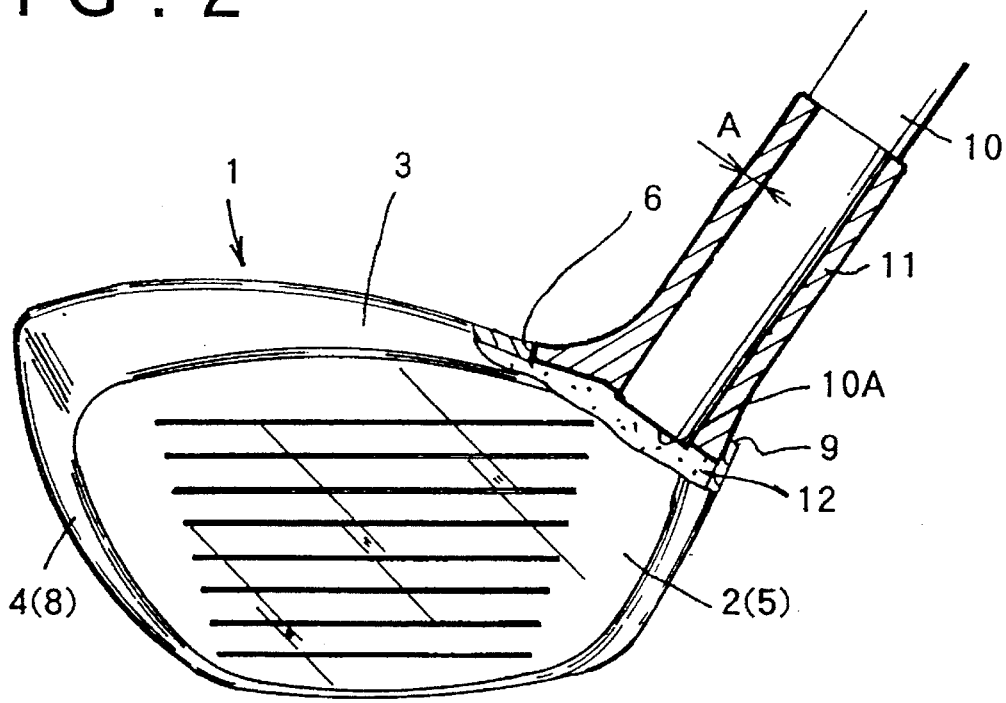
FIG. 2 is a partially cut-away front view showing a first embodiment of the invention.
Figure 3:
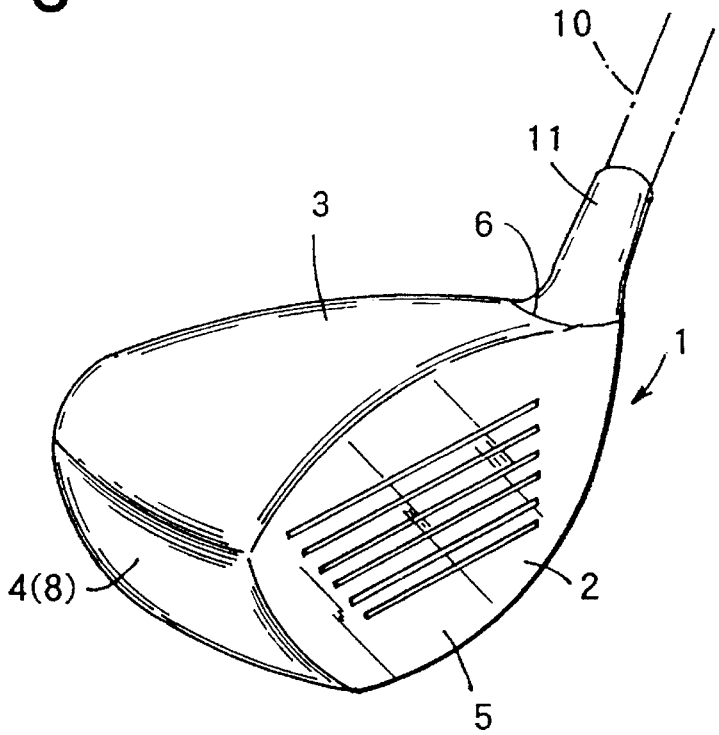
FIG. 3 is a perspective view showing a first embodiment of the invention.

Hereinafter is described a first embodiment of a golf club head of the invention with reference to FIGS. 1 to 3, in which reference numeral 1 designates a head body, which is formed by integrally welding each edge of a face member 2, an upper surface member 3 and a side-peripheral and sole member 4, each of which being made of metallic crust formed by press-working of metal plates of pure titanium, titanium alloy, stainless steel, iron or the like. Among the above-mentioned material, pure titanium or titanium alloy would be most suitable, as their specific gravity are relatively small. Thus, the employment of pure titanium or titanium alloy enables the volume of a head body to be enlarged up to more than 210 cc.

A front surface of the face member 2 is formed with a face 5 as a hitting surface, while one end of the upper surface member 3 is formed with a circular-arc portion 6. The side-peripheral and sole member 4 has a sole 7 at its lower portion and a side-peripheral surface 8 forming lateral side walls and a back wall. Further, one end of the side-peripheral portion 8 is formed with a circular-arc portion 9 as well.

A hosel 11 having a through hole 11A is connected to the circular-arc portions 6 and 9 to mount a shaft 10 thereto. The hosel 11 is approximately cylinder-shaped, formed, for example, from pure titanium, titanium alloy, stainless steel or iron by forging so that its lower end adjacent the face member 2 and upper surface member 3 may form a part of the one side of the upper surface member 3. Preferably, pure titanium or titanium alloy may be employed for lightening thereof. The hosel member 11 is truncated-cone-shaped, of which the thickness A is so provided that the lower end of the hosel 11 adjacent the face 2 is thicker than the upper end thereof, thus the lower end is securely connected to the circular-arc portions 6 and 9 for inserting the shaft 10 into the hosel 11. At that time, a lower end 10A of the shaft 10 is aligned to a lower end of the hosel 11, or otherwise, slightly protrudes downward from the same plane therewith. Incidentally, reference numeral 12 designates foam material such as urethane foam or the like filled into the head body 1.

According to a first embodiment, as the shaft 10 is securely attached to the head body 1 with the same being not connected to the sole 4, the shaft 10 can be lightened, thus enabling the enlarging of a volume of the head body.

Further, as the thickness A of the lower end of the hosel 11 is greater than that of the upper end thereof, the connection strength of the shaft 10 to the head body can be improved.

Figure 4:
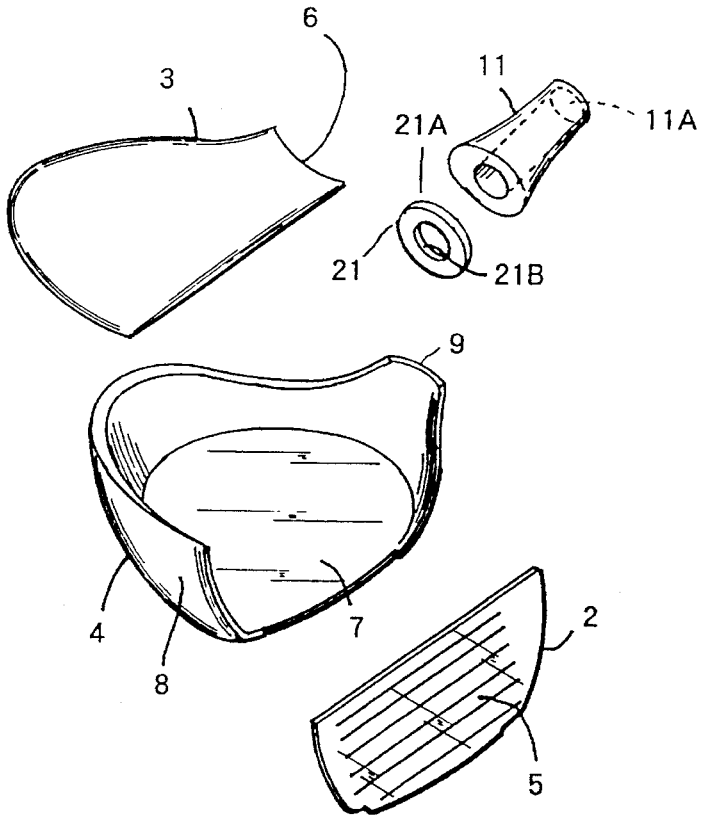
FIG. 4 is an exploded perspective view showing a second embodiment of the invention.
Figure 5:
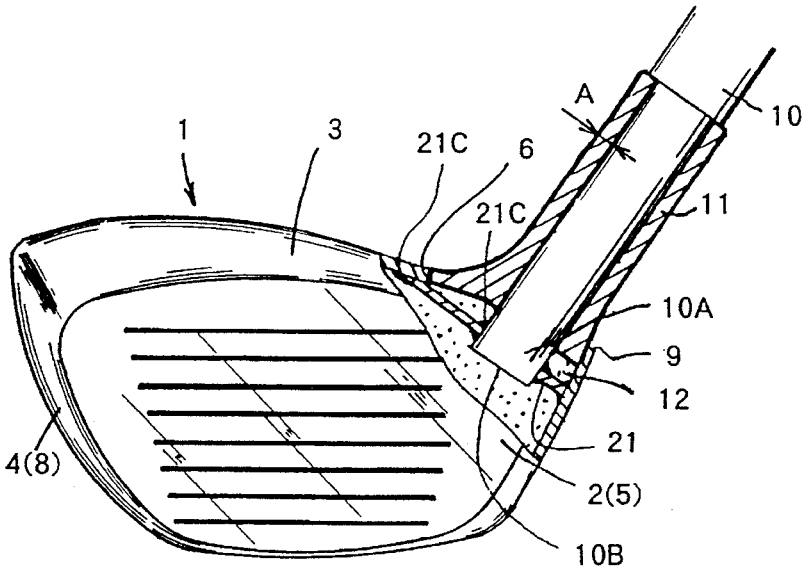
FIG. 5 is a partially cut-away front view showing a second embodiment of the invention.

In FIGS. 4 to 5 showing a second embodiment of the invention, the same portions as those described in a first embodiment are designated at common reference numerals, and their repeated detailed description will be omitted.

In a second embodiment, there is provided the lower end 10A of the shaft 10 slightly protruding downward from the lower end of the hosel 11, thus forming a protrusion 10B. And the protrusion 10B is further provided with a reinforcing member 21 made of pure titanium, titanium alloy, stainless steel or iron. A peripheral portion of 21A of the reinforcing member 21 is securely attached to a suitable position of the head body 1, while into its center hole 21B is inserted the protrusion 10B to be secured thereto. Preferably, the reinforcing member 21 may be made of pure titanium or titanium alloy for the benefit of lightening. Incidentally, reference numeral 21C designates a welding part of the reinforcing member 21.

According to a second embodiment, besides the above-mentioned advantages referred to in connection with a first embodiment, the reinforcing member 21 can realize more enhanced connection strength of the shaft 10 to the head body.

Figure 6:
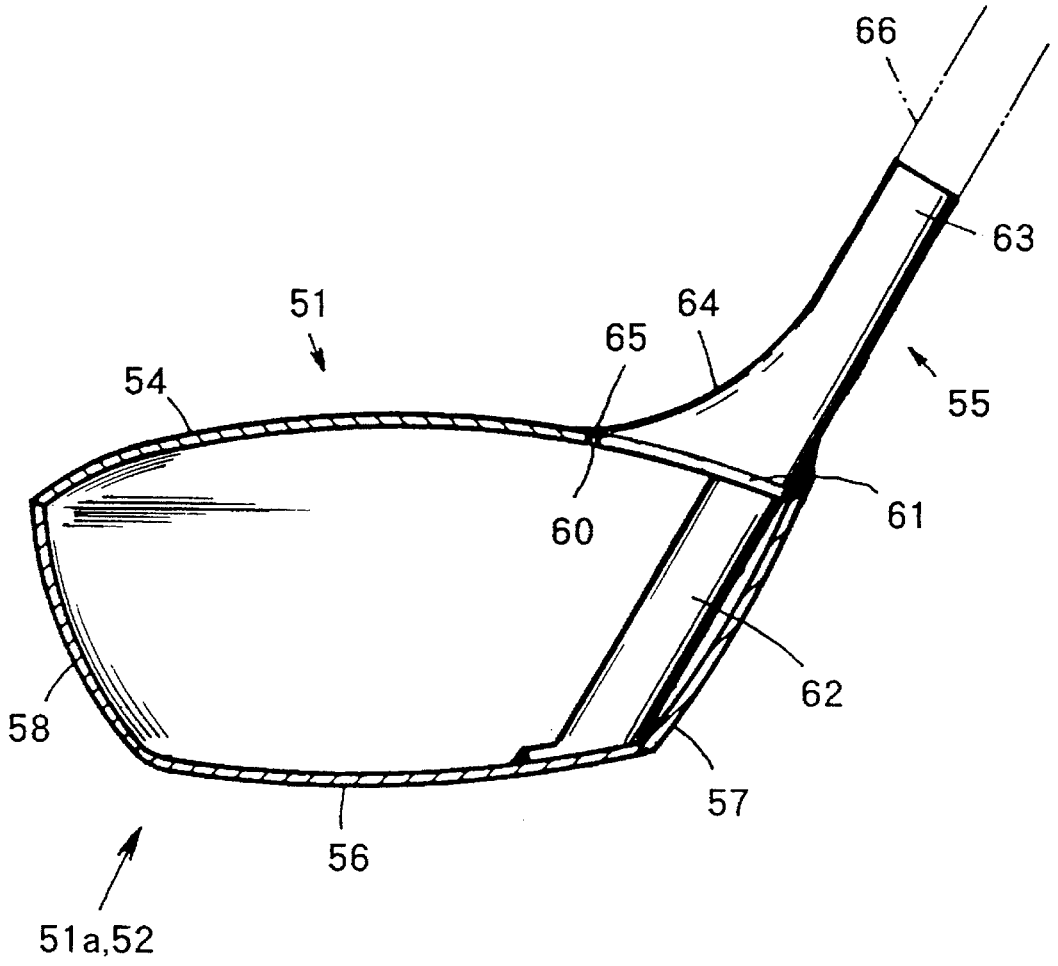
FIG. 6 is a cross-sectional view showing a third embodiment of the invention.
Figure 7:
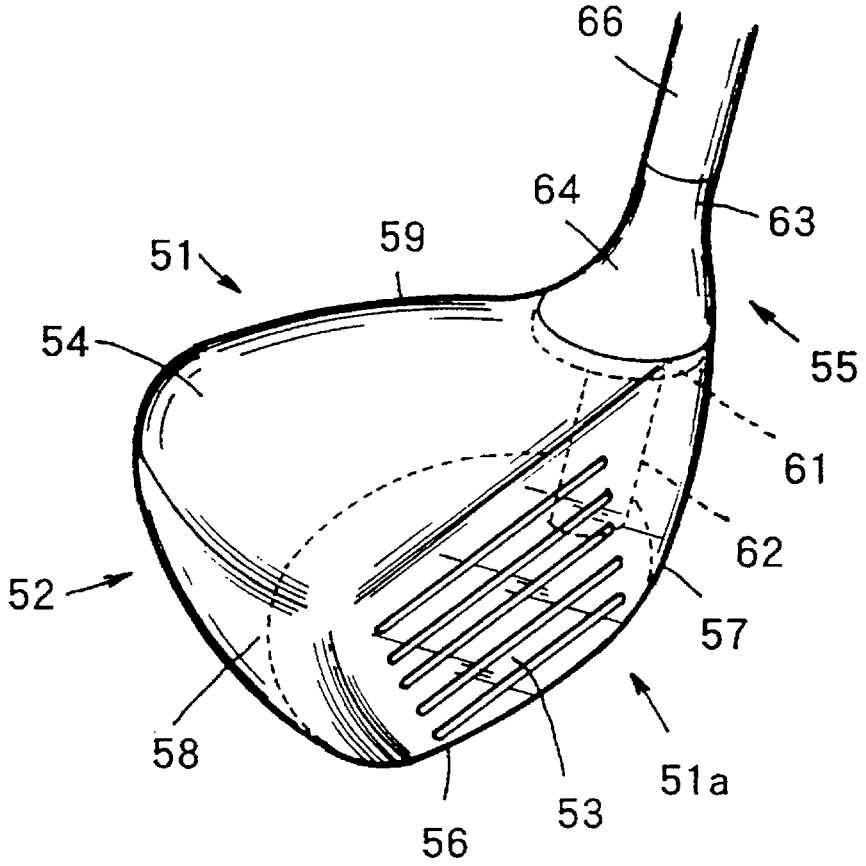
FIG. 7 is a perspective view showing a third embodiment of the invention.
Figure 8:
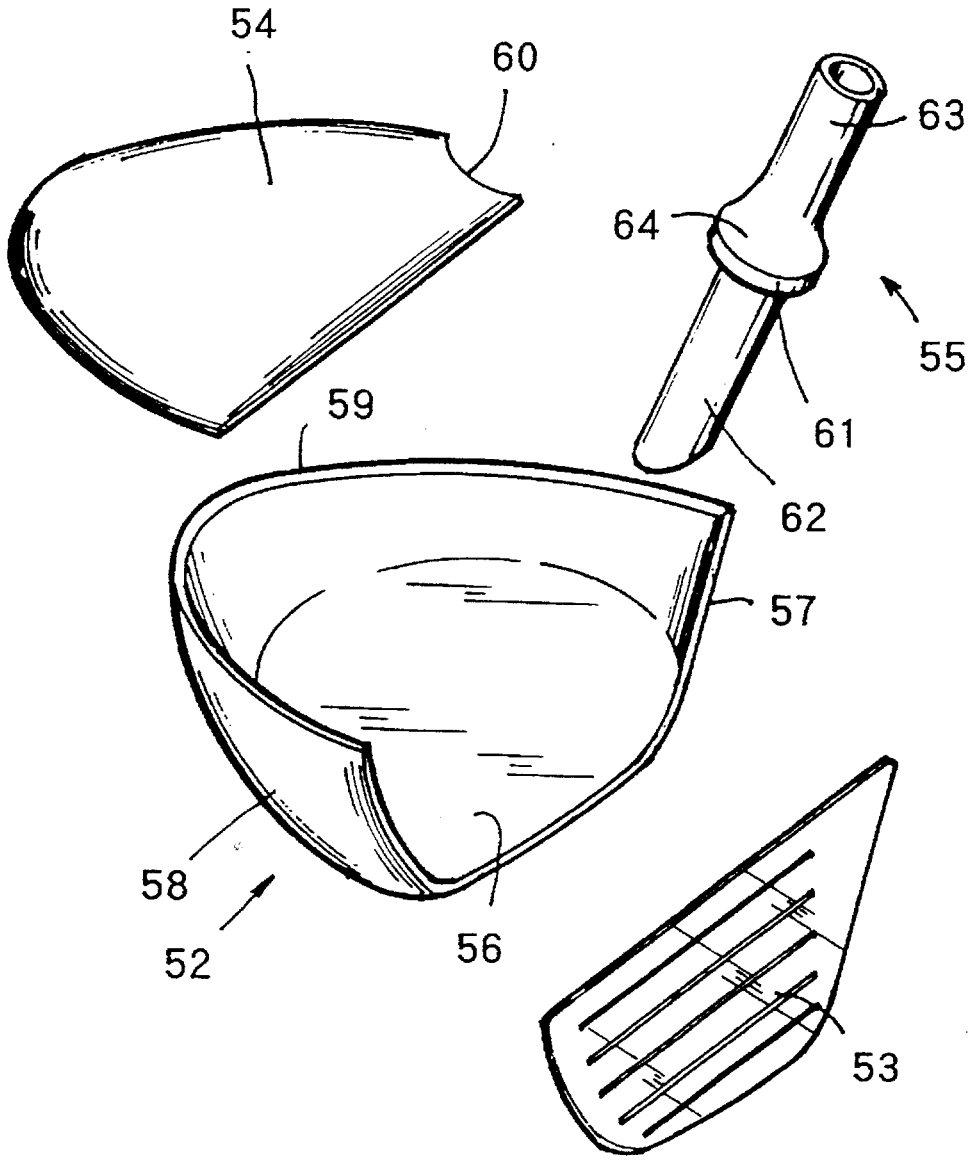
FIG. 8 is an exploded perspective view showing a third embodiment of the invention.
Figure 9:
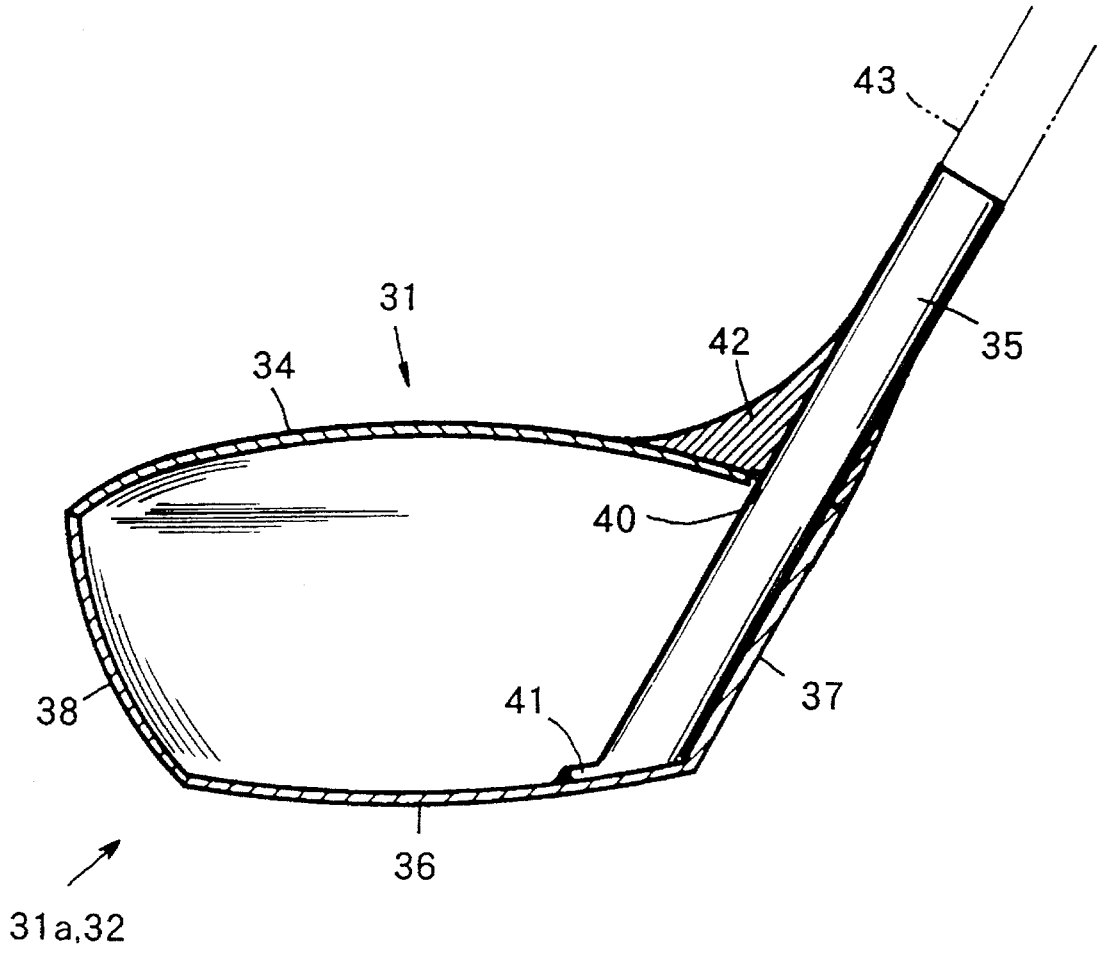
FIG. 9 is a cross-sectional view showing a prior golf club head related to a third embodiment of the invention.
Figure 10:
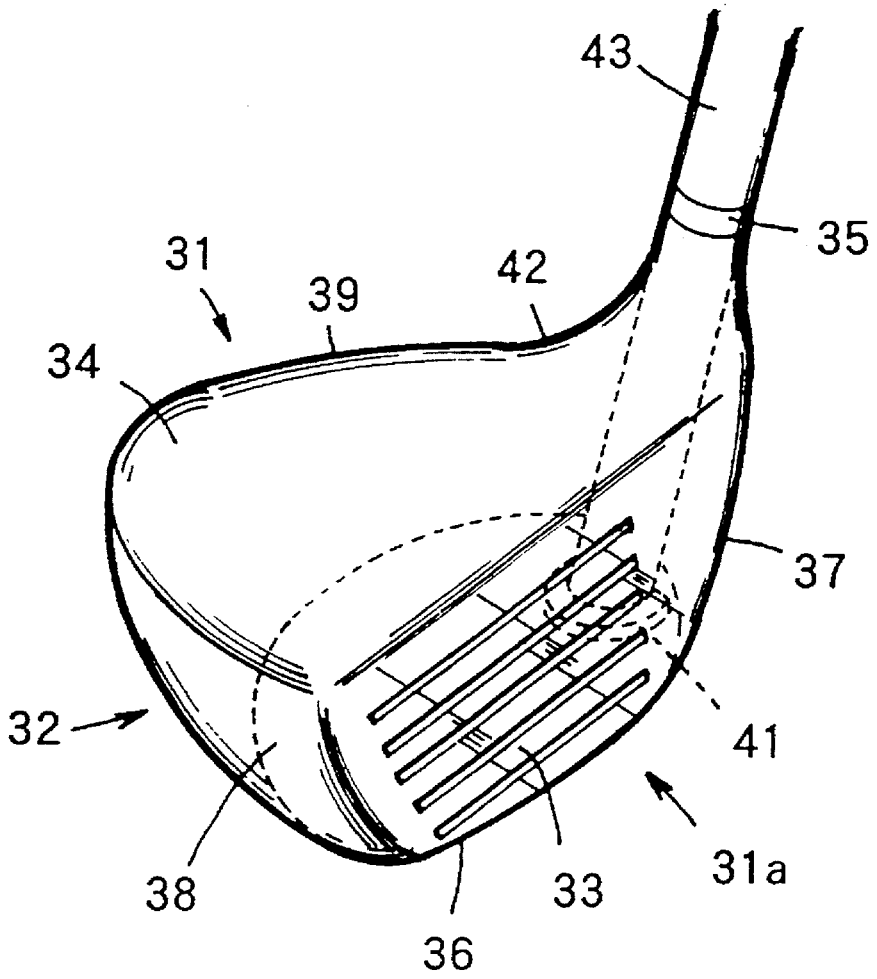
FIG. 10 is a perspective view showing a prior golf club head related to a third embodiment of the invention.
Figure 11:
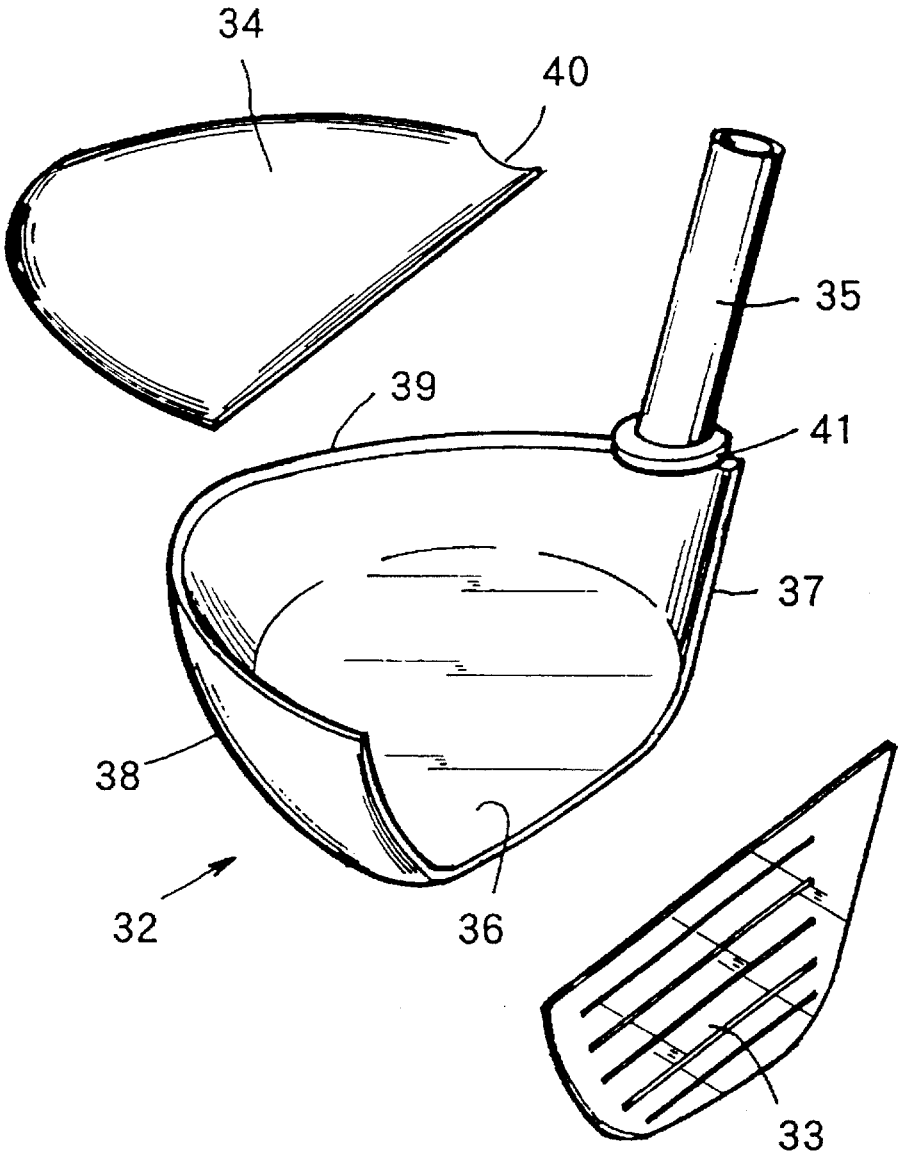
FIG. 11 is an exploded perspective view showing a prior golf club head related to a third embodiment of the invention.

In FIGS. 6 to 8 showing a third embodiment of the invention, reference numeral 51 designates a golf club head of so-called metal wood type as well, comprising a main body member 52, a face member 53, an upper crust member 54 and a hosel member 55. These members 52 to 55 are made of titanium alloy respectively, being welded to one another. The main body member 52 forms a sole 56, a heel 57, a toe 58 and a back 59, thus forming a container-shaped head body 51*a* together with the face member 53. The upper crust member 52 is tabular and secured to an upper surface of the head body 51*a*, covering the same. One end of the upper crust member 54 adjacent the heel 57 is formed with a cut-out portion 60.

The neck or hosel member 55 is a pipe-like forged member having a collar portion 61 at its intermediate position, having coaxial cylindrical portions 62,63 at its both ends integrally extending from the collar 61. One cylindrical member 62 of the hosel member 55 is located within the head body 51*a* with its collar 61 being fitted into the cut-out portion 60. The distal end of the the cylindrical portion 62 is welded to the end of the heel 57 side of the sole 56, while the collar 61 is welded to each end of the upper crust member 54, the face member 53 and the main body member 52. Reference numeral 65 in FIG. 6 designates such welding portions. An upper surface of the collar 61 is formed with a saddle-shaped curved surface 64 defining a continuous and smooth surface between an upper surface of the upper crust member 54 and an outer peripheral surface of the cylindrical portion 63. And then, to the hosel member 55 is connected a shaft 66.

In manufacturing the above golf club head, the face member 53 is first welded to the main body member 52 to form the head body 51*a*, and then, to the main body member 52 is welded the distal end of the hosel member 55 having the collar portion 61 preformed by forging prior to the welding process. Subsequently, the intermediate portion of the hosel member 55 including the collar 61 is welded to each edge of the head body 51*a* and the upper crust member 54. Thereafter, the combined golf club head is polished to a final product to produce a golf club head 51.

With the structure thus made, a large amount of cladding by welding will not be necessary since the welding can be sufficiently attained by welding only a skirt or foot portion of the curved surface 64 to the upper crust member 54. Consequently, the number of working processes for welding the hosel member 55 can be decreased, thus improving its productivity. Further, as the welding is performed in a long peripheral edge of the collar 61 integrally formed by forging in the hosel member 55, the connection strength of the hosel member 55 to the head body 51*a* can be improved.

Incidentally, the present invention should not be limited to the forgoing embodiments, but may be modified within a scope of the invention. For example, the hosel member should not alway be forged but may be cast. Further, the hosel member does not have to be hollow along its entire longitudinal length. Furthermore, each member including the hosel member should not always be made of titanium alloy, but may be made of other metallic material.

What is claimed is:

1. A golf club comprising a shaft, a metallic and hollow head body, and a hosel member combined with a heel side of the head body for connecting said shaft thereto, said golf club head integrally formed from a plurality of metallic crusts including a face crust, an upper crust, a side-peripheral crust and a sole crust, said upper crust formed with an arc-shaped cutting on one side;

the hosel member having a truncated cone-like configuration tapered radially outwardly toward a lower end defining a peripheral side wall along its outer periphery, said peripheral side wall smoothly connected to the arc-shaped cutting by abutting against a side edge thereof, having a thickness equal to the upper crust and forming a part thereof, said hosel member being formed thicker at its lower end, as compared to its upper end, for joining an upper side of the head body thereto; and a lower end of the shaft being provided evenly relative to the lower end of the hosel member, or otherwise, protrudes slightly downward relative to the same.

2. A golf club comprising a shaft, a metallic and hollow head body, and a hosel member combined with a heel side of the head body for connecting said shaft thereto, said golf club head integrally formed from a plurality of metallic crusts including a face crust, an upper crust, a side-peripheral crust and a sole crust, said upper crust formed with an arc-shaped cutting on one side;

the hosel member having a truncated cone-like configuration tapered radially outwardly toward a lower end defining a peripheral side wall along its outer periphery, said peripheral side wall smoothly connected to the arc-shaped cutting by abutting against a side edge thereof, having a thickness equal to the upper crust and forming a part thereof, said hosel member being formed thicker at its lower end for joining an upper side of the head body thereto than at its upper end;

a lower end of the shaft being provided so as to protrude slightly downward relative to the lower end of the hosel member; and a reinforcing member provided between the lower end of the shaft and an inner surface of the head body, said reinforcing member being ring-shaped, having an outer edge secured to the upper crust and the side-peripheral crust, respectively, allowing the lower end of the shaft to be inserted into its center.

3. A wood golf club head having a metallic and hollow head body, comprising:

a face member;

a lower crust member having an aperture thereabove, the lower crust member being container-shaped when combined with the face member;

an approximately tabular upper crust member to be secured to an upper portion of the lower crust member covering the same, said upper crust member having a cutting at its heel side;

a pipe-like hosel member passing through the cutting, of which the distal end is located inside the lower crust member to be welded to the lower and upper crust members, said hosel member having an integral forged collar tapered radially outwardly toward a lower end defining a peripheral side wall along its outer periphery, said peripheral side wall smoothly connected to the cutting by abutting against a side edge thereof at its intermediate position to be fitted into the cutting, and then welded to an arc periphery thereof, thus allowing a curved surface of an outer surface of the collar to define a continuous and smooth concave surface between an upper surface of the upper crust member and an upper cylindrical portion of the hosel member.

4. A wood golf club head according to claim 3, wherein said collar is integrally forged beforehand at the intermediate position of the hosel member.

5. A wood golf club head according to claim 3, wherein said hosel member has a lower end secured to an inner surface of said sole with the same having an extension toward the toe.

* * * * *